United States Patent [19]

Meyer

[11] 4,207,559

[45] Jun. 10, 1980

[54] ALARM SYSTEM WITH ACOUSTICALLY COUPLED TRANSMITTERS AND RECEIVER

[76] Inventor: Michael M. Meyer, 1037D Shary Cir., Concord, Calif. 94518

[21] Appl. No.: 836,755

[22] Filed: Sep. 26, 1977

[51] Int. Cl.[2] ..... G08B 21/00

[52] U.S. Cl. ..... 340/531; 340/506; 340/541; 307/117

[58] Field of Search ..... 340/215, 216, 224, 227 R, 340/228 S, 237.3, 261, 412, 416, 506, 531, 541; 343/225; 307/117

[56] References Cited

U.S. PATENT DOCUMENTS

| | | | |
|---|---|---|---|
| 3,440,347 | 4/1969 | Spencer et al. | 340/416 |
| 4,001,805 | 1/1977 | Golbe | 340/416 |

*Primary Examiner*—Alvin H. Waring

[57] ABSTRACT

An alarm system in which local transmitters emit substantially pure acoustic signals for at least a predetermined minimum interval. The receiver includes a microphone and amplifier for transducing the acoustic signals into electrical signals. These electrical signals pass through two bandpass stages, the second being a phase locked loop circuit. An RC timing network is connected to the second bandpass circuit. After about 7500 cycles of the electrical signal have been received an "alarm received" signal occurs. The "alarm received" signal is applied to the triggering input of a free-running pulse generator which supplies pulse trains to a counter and is itself halted when the counter reaches a first intermediate state. A second "alarm received" signal is required to restart the free-running pulse generator and thus advance the counter beyond said first intermediate state. Thereafter, when the counter reaches a second intermediate state, the occurrence of the corresponding second intermediate state signal actuates a suitable alarm signal to warn of intrusion or some other hazardous condition.

3 Claims, 2 Drawing Figures

ALARM SYSTEM WITH ACOUSTICALLY COUPLED TRANSMITTERS AND RECEIVER

BACKGROUND OF THE INVENTION

1. Field of the Invention.

The present invention relates to alarm systems, such as intrusion alarms, fire alarms, etc., and more particularly to "wireless" alarm systems in which information is transmitted from local transmitter units to one or more central receiver units without the aid of wires.

2. Description of the Prior Art.

Alarm systems wherein emergency condition sensors (e.g., for sensing incipient fire, intrusion, flooding, etc.) are distributed about premises to be protected and interconnected with one or more central control units are well-known in the prior art.

As is further well-known in the prior art, such central control units control the operation of alarm signal producing means, such as bells, gongs, buzzers, electronic sounders, and the like. Further, such prior art alarm system central units are commonly provided with delay means for delaying the actuation of said alarm signal producing means until a predetermined time after an emergency condition signal is transmitted to a central receiving unit from one of said emergency condition sensors, and further provided with key-operated disarming switch means whereby a key-holder may disarm the system and thus prevent the emission of said alarm signals by inserting and turning the key during the delay interval provided by said delay means.

It is also known in the art to provide exit delay means, whereby the key-holder may arm, i.e., electrically actuate, the alarm system, and then leave the protected premises without triggering an alarm, provided the key-holder leaves the protected premises within a very short predetermined delay interval.

It is also known in the prior art to reduce the cost and inconvenience attending the installation of prior art alarm systems by providing "wireless" interconnections between groups of emergency condition sensors and the central control unit or units associated with said groups, each such group of emergency condition sensors being physically located in close proximity to each other, e.g., in a single room or wing of a building, whereby they can easily be interconnected with a local transmitter unit by means of light, substantially invisible wires. In these prior art "wireless" alarm systems, all of the local transmitters of the system are connected by wireless link means, e.g., radio waves or carrier signals on power wiring, to a suitable receiver which itself forms a part of the central control unit.

It has been found, however, that both the prior art radio wave and carrier types of "wireless" alarm systems, and especially those of relatively little electronic complexity, and thus low cost, are susceptible to "false alarms", produced when stray electrical signals, e.g., emanated by diathermy, radar, television, and radio equipment, and certain transients on power lines, are "received" by the receiver of the central control unit and interpreted as emergency condition signals.

SUMMARY OF THE INVENTION

It is therefore an object of the present invention to provide "wireless" alarm and other control systems which are relatively inexpensive and easy to install, and at the same time are relatively free from "false alarms" triggered by stray electrical signals.

It is another object of the present invention to provide "wireless" alarm and other control systems wherein the emergency condition information provided by emergency condition sensors is transmitted to the central control unit or control units by acoustic signals emitted by local transmitter units.

It is yet another object of the present invention to provide unique acoustic signals for use in acoustic wireless alarm systems, which unique acoustic signals so distinguish from generally prevailing stray acoustic signals as to be distinguishable from virtually all such stray acoustic signals by associated receivers, thus greatly reducing or completely eliminating "false alarms".

Other objects of the present invention will in part be obvious and will in part appear hereinafter.

The present invention, accordingly, comprises the features of construction, combination of elements, and arrangement of parts which will be exemplified in the construction hereinafter set forth, and the scope of the present invention will be indicated in the appended claims.

In accordance with a principal feature of the present invention, a remote control system is provided which comprises an acoustic transmitter and an acoustic receiver, control information being transmitted from said acoustic transmitter to said acoustic receiver by acoustic signals each consisting of at least an audible tone of predetermined minimum duration.

In accordance with another principal feature of the present invention, an alarm system is provided which comprises an acoustic receiver and at least one acoustic transmitter, information being transmitted from said at least one acoustic transmitter to said acoustic receiver by acoustic signals each consisting of at least an audible tone of predetermined minimum duration.

In accordance with another principal feature of the present invention, a remote control system is provided which comprises an acoustic transmitter and an acoustic receiver, control information being transmitted from said acoustic transmitter to said acoustic receiver by acoustic signals each consisting of at least a sustained substantially pure sinusoidal tone of predetermined pitch and predetermined minimum duration.

In accordance with yet another principal feature of the present invention, an alarm system is provided which comprises an acoustic receiver and at least one acoustic transmitter, information being transmitted from said at least one acoustic transmitter to said acoustic receiver by acoustic signals each consisting of at least a sustained substantially pure sinusoidal tone of predetermined pitch and predetermined minimum duration.

In accordance with a yet further feature of the present invention, an acoustic receiver for an alarm system is provided, said acoustic receiver comprising transducer means for receiving acoustic signals and transducing them into corresponding electrical signals, and bandpass means for eliminating from said corresponding electrical signals all frequency components lying outside a predetermined pass band.

In accordance with a further feature of the present invention, said bandpass means comprises a first stage and a second stage.

In accordance with a yet further feature of the present invention, said second stage comprises a phase locked loop circuit.

In accordance with an additional feature of the present invention, said acoustic receiver yet further comprises signal duration detecting means for receiving output signals from said second stage and producing a minimum duration detection signal whenever one of said output signals from said second stage is greater in duration than said predetermined minimum duration.

In accordance with yet another feature of the present invention, said acoustic receiver further comprises free-running pulse generating means for producing a train of pulses in response to each of said minimum duration signals, counter means advanced from state to state by said pulses and producing a first state signal when in a first state and a second state signal when in a second state, and pulse train interrupting means for interrupting said pulse trains in response to the occurrence of each of said first state signals.

For a fuller understanding of the nature and objects of the invention, reference should be had to the following detailed description, taken in connection with the accompanying drawings.

DETAILED DESCRIPTION OF THE PREFERRED EMBODIMENT

Figure 1:
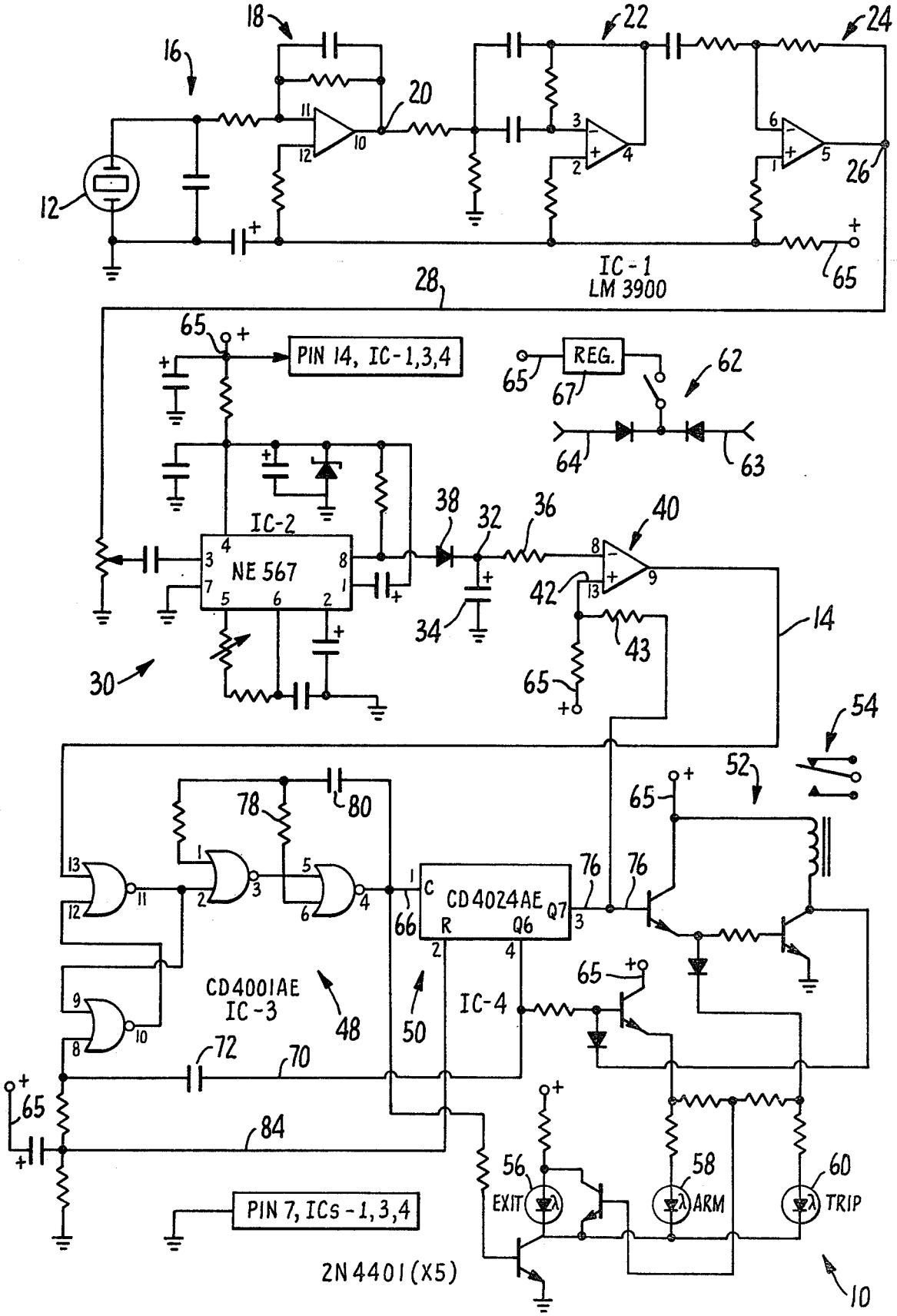
FIG. 1 is a schematic circuit diagram of the central control unit of a preferred embodiment of the present invention, including the acoustic receiver thereof.

Referring now to FIG. 1, there is shown a schematic circuit diagram of the acoustic receiver of the preferred embodiment of the present invention. As will be evident to those having ordinary skill in the art, after being informed by the present specification and drawings, the schematic circuit diagram of FIG. 1 also shows the central control unit circuit of the preferred embodiment of the present invention. It is to be understood that, in accordance with common practice in the "wireless" alarm system art, the entire circuit of FIG. 1 will sometimes hereinafter be called the "receiver", and will be referred to collectively by the reference numeral 10.

As will be further understood from FIG. 1, receiver 10 comprises a ceramic microphone 12, whereby acoustic signals from the associated alarm signal transmitters are received.

As will be evident to those having ordinary skill in the art, microphone 12 will receive many stray acoustic signals emanating from sources other than associated transmitters of the preferred embodiment, and may also receive spurious or cloaking acoustic signals from the associated transmitters of the preferred embodiment. All such stray, spurious, or cloaking signals, from whatever source, will be referred to herein as "undesired acoustic signals", to distinguish them all from the particular acoustic signals of the present invention, which are the only acoustic signals capable of eliciting corresponding signals on line 14 of receiver 10 of FIG. 1.

As will be evident to those having ordinary skill in the art, informed by the discussion of the transmitters of the preferred embodiment hereinbelow, one of the acoustic signals of the present invention is produced whenever one of the associated emergency condition sensors, e.g., door switches, window switches, etc., is tripped, i.e., whenever an emergency condition is sensed by one of the emergency condition sensors of the alarm system of the preferred embodiment.

For this reason, the acoustic signals of the present invention will sometimes herein be called "acoustic EC signals".

For the same reason, the significant signals on line 14 of receiver 10 will sometimes be called "electrical EC signals" hereinafter.

In the preferred embodiment, the acoustic EC signal will be a continuous train of three kilocycle per second sinusoids of at least 2.5 seconds duration. In other words, the acoustic EC signal of the preferred embodiment may be thought of as pure (sinusoidal) tone the pitch of which is 3000 vibrations per second and which is sustained for at least 2.5 seconds, or 7500 cycles or vibrations.

It is to be understood, however, that the acoustic EC signal of the present invention is not limited to a particular frequency, and in particular is not limited to the audible frequencies. It is further to be understood that the acoustic EC signal of the present invention is not limited to a particular predetermined minimum duration, although the 2.5 second duration of the preferred embodiment has been found in actual practice to affectively discriminate against virtually all stray acoustic signals found in the usual home or apartment environment, including the loudspeaker outputs of television sets and high fidelity sets, resulting in a very low "false alarm rate" as compared with radio wave link or power line carrier link alarm systems of comparable cost to the consumer.

Referring again to FIG. 1, and assuming the first vibration or cycle of an acoustic EC signal of the preferred embodiment of the present invention to have just been received by microphone 12, the operation of receiver 10 which produces the corresponding electrical EC signal on line 14 about 2.5 seconds later will now be described.

As will be apparent to those having ordinary skill in the art, the output signal from microphone 12 is conditioned by a matching network 16 of well-known type and then amplified by an integrated circuit operational amplifier connected as a high quality audio amplifier 18, producing at point 20 a signal which is the electrical equivalent of the total acoustic signal received by microphone 12, including not only the said acoustic EC signal but also any spurious or cloaking signals produced by the transmitter producing said acoustic EC signal and stray acoustic signals from other sources. The matching network and the auxiliary components making up audio amplifier 18 are such as may be selected by those having ordinary skill in the art without the exercise of invention.

For clarity, it is pointed out here that the signal at point 20 is *not* the electrical EC signal described hereinabove and produced on line 14.

Referring again to FIG. 1 it will be understood by those having ordinary skill in the art, without the exercise of invention, that audio amplifier 18 is connected in cascade with an integrated circuit operational amplifier connected with certain discrete circuit components to provide a very narrow band pass filter 22, and with another stage of high quality audio amplification 24. The integrated circuit operational amplifier and associated discrete components of active band pass filter 22 are so selected that the center frequency of active band pass filter 22 is 3 kilocycles per second (3 kHz) and the Q of this filter is about 5 to 20.

Thus, it will be understood that the signal occurring at point 26 at the abovesaid assumed time, i,e., the time when the first cycle or vibration of an acoustic EC signal has just been received by microphone 12, will be the equivalent of the signal at point 20 stripped of nearly all spurious, stray, and cloaking signals, i.e., will consist principally of a substantially pure 3000 cycle per second electrical sine wave. The signal at point 26 is supplied to the input terminal of a second band pass stage 30 via lead 28.

It is to be understood that for clarity subcircuits 22 and 30 are sometimes herein referred to as "band pass means", subcircuit 22 being referred to as a first stage or first band pass stage and subcircuit 30 being referred to as a second stage or second band pass stage.

Referring again to FIG. 1, it will be seen that second band pass stage 30 comprises a well-known NE567 phase locked loop integrated circuit, sometimes sold variously as SE567, LM567, or NE 567, and sold by the Radio Shack Corporation under Stock No. 276-1721.

As will be evident to those having ordinary skill in the art, informed by the present specification and drawings, and particularly FIG. 1, the NE567 integrated circuit of second band pass stage 30 is interconnected with certain discrete components to provide a complete phase locked loop circuit. The selection of component values, bias voltage magnitudes, etc., is such that the voltage on output pin 8 of the NE567 integrated circuit is about 6.2 volts positive (direct current volts above system ground) whenever *no* 3 kilocycle per second signal is present at input pin 3 of the NE567 integrated circuit.

When, however, a 3 kilocycle per second electrical signal appears on input pin 3 of the NE567 integrated circuit, the signal at pin 8 thereof drops from the "normal" 6.2 volt level towward system ground, the magnitude of the drop from the "normal" voltage level being dependent upon the amplitude of the 3 kilocycle per second signal on input pin 3 of the NE567 integrated circuit.

The selection of the NE567 integrated circuit and its associated discrete components is such that in order to produce the just-described drop of the voltage signal on output pin 8 of the NE567 integrated circuit, the voltage signal on input pin 3 must have a frequency of 3 kilocycles per second plus or minus 4%.

Referring again to FIG. 1, it will be seen that the output signal on pin 8 of the NE567 integrated circuit is applied to the common point 32 of an RC-network consisting of capacitor 34 and resistor 36 through a silicon diode 38.

As further seen in FIG. 1, the non-common terminal of resistor 36 is directly connected to one input terminal (pin 8) of an integrated circuit operational amplifier 40, and the other input terminal of integrated circuit operational amplifier 40 (pin 13) is connected to a relatively fixed voltage level.

As also seen in FIG. 1, the output signal from integrated circuit operational amplifier 40, on line 14, is the above-described electrical EC signal, or electrical emergency condition signal.

The values of capacitor 34 and resistor 36, and the circuit type of integrated circuit operational amplifier 40, along with the then relatively fixed bias potential on the lower or positive input terminal 42 of integrated circuit operational amplifier 40, are so chosen that when the output pin 8 of the NE567 integrated circuit amplifier is at its above-described "normal" 6.2 volt positive level capacitor 34 is continuously *discharged* through silicon diode 38, and the voltage of point 32 is close to system ground; and that when 3 kilocycle per second sinusoidal signals are being received at input pin 3 of the NE567 integrated circuit operational amplifier, and thus the voltage on output pin 8 has dropped toward system ground, diode 38 is blocked, and capacitor 34 accumulates charge through a path including resistor 36 and the internal circuit of integrated circuit operational amplifier 40.

The effective parameters of RC-network 34, 36, including the impedance of said internal circuit of integrated circuit operational amplifier 40, are so chosen that the potential at point 32 due to increasing charge on capacitor 34 will not reach a sufficiently high level to exceed the potential on input terminal 42, and thus produce a signal (the electrical EC signal) until approximately 7500 successive, substantially uninterrupted cycles of 3 kilocycle per second signal have occurred at input pin 3 of the NE567 integrated phase locked loop circuit.

Put differently, an electrical EC signal occurs on lead 14 after, and only after, the composite acoustic signal received by microphone 12 has immediately previously comprised an acoustic EC signal, i.e., an uninterrupted pure sinusoidal tone sustained for at least 2.5 seconds (7500 cycles or vibrations).

If the acoustic EC signal continues for 2.5 seconds the voltage on line 14 will go to its L level (the H level being the "normal" level) and will remain at its L level until the acoustic EC signal ceases, unless meanwhile the potential on terminal 42 changes as described hereinbelow, in which case the L level signal will remain on line 14 after the acoustic EC signal ceases.

The acoustic receiver portion of the receiver or receiver unit 10 of the preferred embodiment of the present invention having been described in detail hereinabove, the central control portion of receiver unit 10 will now be described in detail.

The principal subcircuits of the central control portion of receiver 10 are a free-running pulse generator 48, a counter 50, an output relay amplifier 52, and output relay 54, condition signal lights 56, 58, and 60, and a key-operated arming switch 62 of well-known type.

Switch 62 is interposed between the alternative circuit power sources 63 and 64 and a voltage regulator 67 which serves to maintain on common positive supply points 65 a relatively stable direct current voltage of approximately 10 volts. Source 63 is a 9 volt transistor battery (alkaline) of well-known type. Source 64 is an alternating current adaptor of well-known type adapted to be plugged directly into a wall outlet, and to provide approximately 12 volts direct current at 200 milliamperes at point 64.

Free-running pulse generator 48, which in the preferred embodiment comprises the gates of a well-known CD4001AE integrated circuit interconnected in well-known manner to serve as a free-running pulse generator is triggered by each electrical EC signal on lead 14 to produce a train of pulses on lead 66, which pulses serve to advance counter 50 through its successive states in the well-known manner. In the preferred embodiment counter 50 is a type CD4024AE integrated circuit counter.

In now describing the operation of the central control unit portion of the receiver 10 of FIG. 1 it will first be assumed that the alarm system of the preferred embodiment is installed in an apartment. This installation includes one transmitter (as later described in connection with FIG. 2) located in each room of the apartment. Every door and window of the apartment is provided with a suitable alarm switch unit. For example, the main door of the apartment is provided with an encapsulated magnetic reed switch mounted on its frame and a magnet mounted on the door itself, so that, in the well-known manner, the magnetic reed switch is open whenever the main door of the apartment is open. The two terminals of this magnetic reed switch are connected in series with other switches similarly protecting windows in the same room of the apartment, and this series connection of door and window alarm switches is itself connected across the two sensor terminals of the transmitter for that room of the apartment, all by means of very light, virtually invisible wiring of the kind sometimes used for interconnecting high fidelity speakers and their associated amplifiers. Thus, it will be seen that if any door or window protected by one of these alarm switches is opened, the circuit between the sensor terminals of the transmitter will be broken or opened.

As explained hereinafter, the breaking or opening of the circuit interconnecting the two sensor terminals of any transmitter causes the loudspeaker of that transmitter to emit an acoustic EC signal of the kind described at length hereinabove, which acoustic EC signal will be sustained for slightly more than 7500 vibrations or cycles, even if the opening of the circuit between the sensor terminals of the transmitter is only momentary, e.g., 15 milliseconds in duration.

Further, it will be initially assumed in describing the operation of the central control unit portion of receiver 10 (FIG. 1) that key-operated switch 62 is open, and that thus supply points 63 and 64 are disconnected from the balance of the receiver circuit.

It should be noted at this point that none of the transmitters is provided with an on-off power switch. Rather, the circuit of each transmitter is directly and permanently connected to the supply battery terminals, so that operating bias is supplied to the transmitter circuit whenever batteries are in place in the suitable cavity provided in the transmitter housing.

Given these presumed initial conditions, then, let it further be assumed that the sole occupant of the apartment wishes to leave the apartment, and to arm the alarm system, so that the opening of any door or window in the apartment thereafter, i.e., so long as the alarm system is armed, will result in the closing of the contacts of relay 54, and the consequent sounding of an alarm device connected across the terminals of relay 54.

To thus arm the alarm system of the preferred embodiment, the occupant inserts his key in key switch 62, which is mounted on the face panel of receiver 10, and operates key switch 62 to its ON state or "circuit closed state", thereby connecting the circuit of receiver 10 to supply points 63 and 64.

Thereafter, whenever the occupant leaves the apartment through any protected door or window (and promptly recloses that door or window) the resulting acoustic EC signal emitted by the transmitter associated with that door or window is picked up by microphone 12 (FIG. 1) and, as hereinabove described, causes free-running pulse generator 48 to supply a train of pulses to integrated circuit binary digital counter 50 (FIG. 1).

This train of pulses emitted by pulse generator 48 advances counter 50 through its successive states of operation until it reaches a first intermediate state of operation at which a Q6 state signal is produced at pin 4 of counter 50. Pin 4 of counter 50 is so interconnected to pulse generator 48 via line 70 and capacitor 72 that the occurrence of this first intermediate state signal on pin 4 terminates the operation of pulse generator 48, leaving counter 50 in its Q6 or first intermediate state.

It is to be particularly noted, however, that at this time, i.e., when the occupant leaves the apartment, alarm relay 54 is *not* operated, since the input signal to relay amplifier 52 on line 76 is not provided by the first intermediate or Q6 state signal output pin 4, but rather is supplied from the second intermediate or Q7 state signal output pin 3 of counter 50.

The associated alarm signal means will not be actuated until the subsequent opening of an apartment door or window causes the production of a second acoustic EC signal, resulting in the production of an electrical EC (L level) signal on lead 14, thus starting pulse generator 48 and causing it to emit a further train of pulses. This train of pulses successively advances counter 50, state-by-state, until the second intermediate state or Q7 state is reached.

(In accordance with a particular feature of the present invention, however, the associated alarm signal means will be actuated if the occupant, on leaving the apartment, leaves the exit door standing open. In this case, the associated alarm signal means will be actuated after the exit door has stood open for approximately 15 seconds.)

As is well-known to those having ordinary skill in the art, pin 3 of a type CD4024AE integrated circuit binary digital counter occupies a first or L electrical signal level while this counter is in its ZERO or RESET state, and while this counter is progressing, state-by-state, to its Q7 state, and occupies a second or H signal level while this counter is in its Q7 state, and while this counter is advancing, state-by-state, to its ZERO or RESET state.

Thus, when counter 50 reaches its second intermediate or Q7 state, while being advanced state-by-state by pulse generator 48, an H signal appears at pin 3, and remains on pin 3 until pulse generator 48 has pulsed counter 50 back to its ZERO or RESET state.

The H signal on pin 3, applied to pin 13 of intergrated circuit operational amplifier 40 via resistor 43, produces an H signal at pin 13 of pulse generator 48, thus assuring that pulse generator 48 will continue operating until counter 50 has returned to its reset state.

Thus, the H signal on line 76, amplifier by relay amplifier 52, energizes and switches alarm relay 54 and causes alarm relay 54 to remain in its alarm device operating state until counter 50 is advanced to its ZERO or RESET state.

As will now be described, two features of the present invention result from the just-described mode of operation of pulse generator 48, counter 50, etc.

The first of these features is the "reentry interval" feature which makes it possible for the occupant of the apartment on returning to the apartment to open a door of the apartment go directly to receiver 10 and turn off or disarm the system by means of key switch 62, all without sounding the associated alarm signal producing device.

This "reentry interval" mode of operation is made possible by the fact that on opening a protected door or window while the system is in the armed state and counter 50 is in the first intermediate state or Q6 state relay 54 is not operated immediately, or after the above-said 2.5 second interval, but is only operated when counter 50 reaches the second intermediate or Q7 state. In the device of the preferred embodiment the value of resistor 78 is so chosen and the value of capacitor 80 is so chosen that 20 seconds elapses during the advance of counter 50 from the first intermediate or Q6 state to the second intermediate or Q7 state, thus giving the occupant of the apartment ample time to open a door of the apartment walk to receiver 10 and deenergize receiver 10 by means of key switch 62 before relay 54 operates and the associated alarm signal producing device is actuated. Other values of reentry delay interval may be made selectable by means of a switch on the rear panel of receiver 10, such as a 12 second interval and a 35 second interval.

(It is also due to these selected values of resistor 78 and capacitor 80, determining the period of pulse generator 48, that if the occupant accidentally leaves open the door through which he leaves the apartment the associated alarm means is not actuated until the expiration of approximately 15 seconds, as pointed out supra.)

The second of these two features is what is called the "alarm saver feature".

As is well-known to those having ordinary skill in the art, high intensity alarm bells and the like are subject to burning out, i.e., being completely destroyed by heat build up from high currents in their operating coils, when continuously operated for as little as an hour or two.

It is well-known to be highly desirable, on the other hand, in alarm systems in general, to substantially continuously operate the alarm signal producing device, e.g., high intensity bell or the like, until the alarm system is disarmed by means of the usal key switch.

In the preferred embodiment of the present invention this problem is solved by providing a reset connection 84 which overrides the pulse train interrupting action of connection 70 during every cycle of pulse generator 48 except any cycle immediately following the reenergization of receiver 10 by key switch 62, thus assuring that the alarm signal producing device connected to alarm relay 54 will be operated on approximately 50% duty cycle by the continual cycling of counter 52 until receiver 10 is disarmed by means of key switch 62, unless the door or window the opening of which triggered the alarm is subsequently closed.

Figure 2:
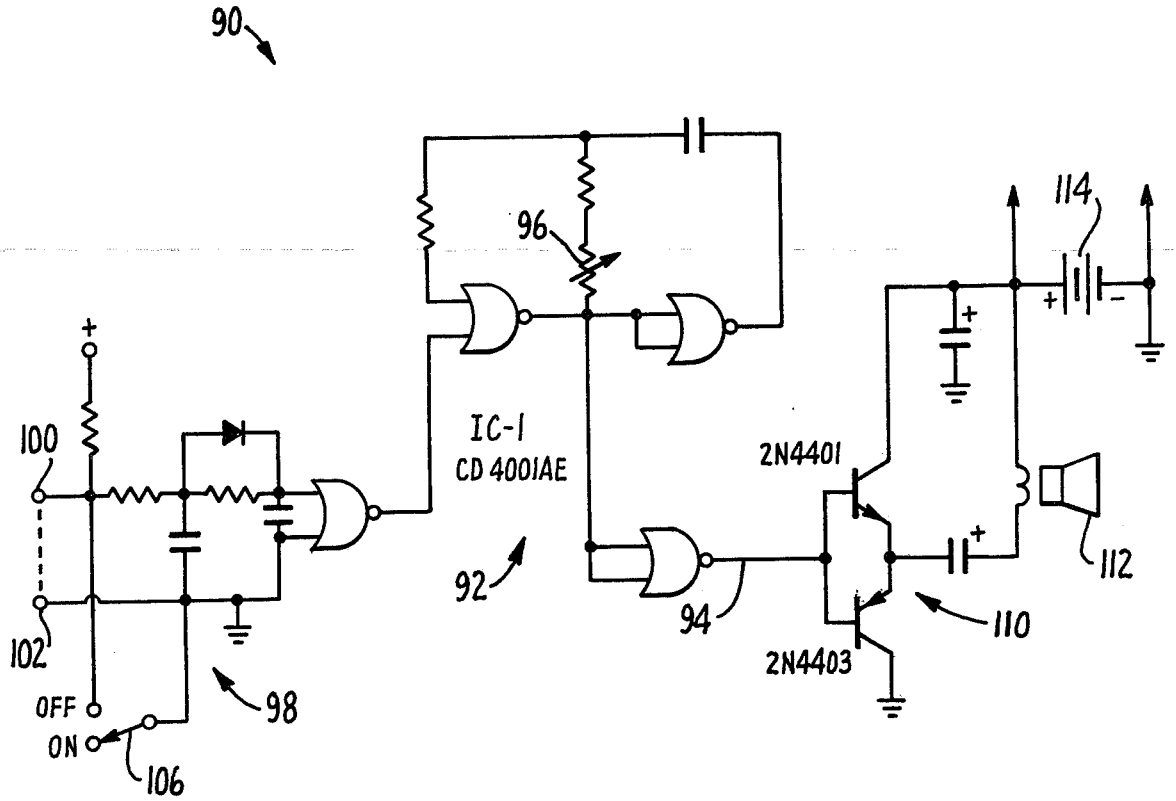
FIG. 2 is a schematic circuit diagram of one of the acoustic wireless transmitters of said preferred embodiment of the present invention.

Referring now to FIG. 2, there is shown a schematic circuit diagram of one of the transmitters of the preferred embodiment of the present invention.

The transmitter of FIG. 2 will generally be referred to hereinafter by the reference numeral 90.

A principal subcircuit of transmitter 90 is sine wave generator 92.

Sine wave generator 92 comprises the four gates of a CD4001AE integrated circuit interconnected in the well-known manner to produce a sinusoidal signal on line 94 when properly excited.

As is well-known to those having ordinary skill in the art, such oscillators are in general very stable, in that they tend to produce very pure sinusoidal waves of substantially fixed frequency.

It will be noted, however, that a screwdriver potentiometer 96 is provided for factory calibration to assure that the frequency of the sinusoidal output wave on line 94 is very close to 3 kilocycles per second.

Another principal subcircuit of transmitter 90 is the minimum tone duration circuit 98. Minimum tone duration circuit 98 is an RC-network the time constant of which is so selected as to assure that whenever sensor terminals 100, 102 are disconnected, having previously been connected, sine wave generator 92 will commence to produce a continuous sine wave at terminal 94 and continue to do so for at least 2.5 seconds, even if sensor terminals 100, 102 are immediately reconnected. If, however, sensor terminals 100, 102 are disconnected for more than 2.5 seconds, the substantially pure sinusoidal signal on terminal 94 continues to exist until sensor terminals 100, 102 are reconnected.

In accordance with a further feature of the present invention, a switch 106 is connected between sensor terminals 100, 102, whereby transmitter 90 may be prevented from emitting any acoustic signals simply by operating switch 106 into its closed position (OFF position).

As further seen in FIG. 2, each transmitter of the preferred embodiment also comprises a power amplifier 110 which amplifies the sinusoidal signal on line 94 and impresses the amplified signal upon the coil of a loudspeaker 112. Loudspeaker 112 serves as the emitter of the acoustic EC signals for the door or window switches or the like connected across the sensor terminals 100, 102 of the associated transmitter.

In the preferred embodiment each transmitter 90 is powered by a 9 volt alkaline transistor battery 114.

It will thus be seen that the objects set forth above, among those made apparent from the preceding description, are efficiently attained, and since certain changes may be made in carrying out the above method and in the construction set forth without departing from the scope of the invention it is intended that all matter contained in the above description or shown in the accompanying drawings shall be interpreted as illustrative only and not in a limiting sense.

It is particularly noted that although the method and apparatus of the invention have been disclosed as embodied in an alarm system the invention also embraces remote control and other communication systems embodying the method of the invention.

It is further particularly noted that although the invention has been disclosed as embodied in an alarm system located entirely in a single building the method and apparatus of the invention also embrace alarm systems in which the protected space or apparatus is located in more than one building, or located out of doors. Thus, in one embodiment of the invention, a transmitter of the kind shown in FIG. 2 is installed in the personal automobile of the occupant of said apartment, which is parked outside the apartment, and the power amplifier 110 and speaker 112 of the transmitter installed in the automobile are sufficiently powerful so that they can actuate the receiver (FIG. 1) located inside said apartment. In this case, the terminals 100, 102 of the transmitter in the occupant's automobile will be connected to suitable door switches, hood lock switches, or ignition switch contacts, so that the occupant of said apartment will be warned by actuation of his receiver (FIG. 1) whenever an attempt is made to vandalize or make off with his automobile. Similarly, such a high output transmitter or transmitters may be installed in an outbuilding, whereby to warn the owner by means of his receiver, located in the main building, of any attempt to enter the outbuilding.

It is yet further particularly noted that although the invention has been disclosed as embodied in an alarm system wherein the transmitters are fixedly located the method and apparatus of the invention embrace alarm systems in which a transmitter is hand-carried or worn by an individual human being, such as a security guard or invalid. Thus, a security guard or invalid may be provided with a small, light, inexpensive transmitter (about the size of a small transistor radio), whereby he or she may broadcast an alarm to an associated receiver (FIG. 1) by simply depressing a pushbutton located on the unit. Furthermore, such a portable, individual transmitter may be provided with a mercury switch so located within the transmitter case as to emit an acoustic EC signal whenever the transmitter unit is tipped on its side, but to emit no such signal as long as the transmitter unit remains upright. Such an orientation-sensitive transmitter may, for example, be worn by an invalid or security guard, strapped to the upper body in its non-alarm position, and thus serve to actuate the associated receiver (FIG. 1) when the invalid, or semi-invalid, falls without having closed switch 106, or when the security guard meets with foul play and thus is knocked unconscious and lies in a prone position.

It is also to be understood that the following claims are intended to cover all of the generic and specific features of the invention herein described, and all statements of the scope of the invention which, as a matter of language, might be said to fall therebetween.

What is claimed is:

1. An acoustic receiver for an alarm system, comprising:

transducer means for receiving acoustic signals and transducing them into corresponding electrical signals;

bandpass means for eliminating from said corresponding electrical signals all frequency components lying outside a predetermined pass band, said bandpass means comprising a first stage and a second stage;

signal duration detecting means for receiving output signals from said second stage and producing a minimum duration detection signal whenever one of said output signals from said second stage is greater in duration than a predetermined minimum duration;

free-running pulse generating means for producing a train of pulses in response to each of said minimum duration detection signals;

counter means advanced from state to state by said pulses and producing a first state signal when in a first state and a second state signal when in a second state, and pulse train interrupting means for interrupting said pulse trains in response to the occurrence of each of said first state signals.

2. An acoustic receiver for an alarm system as claimed in claim 1, further comprising alarm actuating means responsive to said second state signal to actuate visible or audible alarm means.

3. An acoustic receiver for an alarm system as claimed in claim 2 in which said second stage comprises a phase locked loop circuit.

* * * * *